US005703955A

United States Patent [19]

Fels et al.

[11] Patent Number: 5,703,955

[45] Date of Patent: Dec. 30, 1997

[54] METHOD AND APPARATUS FOR MULTICHANNEL SOUND REPRODUCTION

[75] Inventors: Peter Fels; Ulf Wüstenhagen; Gerhard Steinke, all of Berlin, Germany

[73] Assignee: Deutsche Telekom AG, Germany

[21] Appl. No.: 477,036

[22] Filed: Jun. 7, 1995

[30] Foreign Application Priority Data

Nov. 9, 1994 [DE] Germany ..... 44 40 014.4

[51] Int. Cl.[6] ..... H04R 5/00

[52] U.S. Cl. ..... 381/18; 381/19; 381/1

[58] Field of Search ..... 381/18, 17, 1, 381/19, 20, 24; 340/825.24, 825.25

[56] References Cited

U.S. PATENT DOCUMENTS 5,199,075 3/1993 Fosgate ..... 381/18

FOREIGN PATENT DOCUMENTS 34 13 181 6/1991 Germany .

2151439 7/1985 United Kingdom ..... 381/1

OTHER PUBLICATIONS

Proposed SMPTE Recommended Practice—Loudspeaker Placements For Audio Monitoring In High-Definition Electronic Production, RP 173, pp. 1–3.

Lauridsen, H. et al. "MIS-Loudspeaker" Gravesamel Blatter, Switzerland 1956 Aug. No. V pp. 28–50.

*Primary Examiner*—Minsun Oh

*Attorney, Agent, or Firm*—Kenyon & Kenyon

[57] ABSTRACT

A multichannel sound reproduction method and apparatus are described for achieving a higher proportion in the overall room size for acoustic/visual use, which can be used for the listening-position-independent reproduction of spatial information in maintaining the given directional information of the individual sound signal sources. In the described method, each signal is split up and, after a summation, part of it with an increased delay, a modified level and a changed phase position is supplied to one of the unchanged signal portions, with the aggregate signals being distributed and supplied to the two surround reproduction channels and to other reproduction loudspeakers distributedly located in the room in conformity with directional allocation and in accordance with the relevant unchanged signal portions. To this end, an apparatus consisting of matrix and processing modules for electroacoustic adaptation and optimization of given listening zones is described, which checks the parameters of the reproduction arrangement and corrects them in the existing reproduction channels using controllable matrixing and processing modules. The described method and apparatus are suited for the reproduction of direction-oriented sound signals that are transmitted or stored.

11 Claims, 6 Drawing Sheets

METHOD AND APPARATUS FOR MULTICHANNEL SOUND REPRODUCTION

FIELD OF THE INVENTION

The present invention relates to a method and apparatus for multichannel sound reproduction. More specifically, the present invention relates to a method and apparatus for the processing of sound signals that are recorded, transmitted and/or matrixed in a multichannel fashion before being reproduced.

BACKGROUND INFORMATION

Systems and related reproduction arrangements for processing multichannel sound signals are described in ITU-R (formerly CCIR) recommendation BS.775 and in SMPTE standard PR 173 (1992) for a 3/2, 3/4 or 3/2/1 system.

For the reproduction of sound in living rooms and small or medium-sized performance and listening rooms, and in applications involving video presentations, conventional two-channel stereo reproduction equipment is used in most cases. However, in the case of two-channel stereo sound reproduction, there is only a very small tubular stereo listening zone with only one reference position. Another disadvantage of two-channel stereophonic reproduction is the representation of a mid-plane signal with restricted sound and location quality, which becomes possible only through phantom sound source formation.

It is also known to transmit a true mid-plane signal and true half-left and half-right signals (5-channel stereophony), respectively, and to radiate them separately. Moreover, it is known to provide the listener, in addition to the commonly used two-channel stereophonic transmission and primary provision with direct information, with spatial information as well, by means of a stereophonic reproduction equipment. This information is allocated and transmitted as side signals being either separate or in phase opposition, correlated or non-correlated, and radiated via additional loudspeakers which are distributed across in the room.

An effort to combine and transmit all of the aforementioned signals in a uniform format has lead to the proposal of the ITU-R recommendation BS. 775 as well as the SMPTE standard PR 173 for a 3/2, 3/4 or 3/2/1 system.

Another proposal, the SDDS system developed by Sony, is an 8-channel system with five front, two surround and one sub-bass channel.

Furthermore, in developing a multichannel sound processing system, it must be taken into account that multichannel sound transmissions are to be linked with the implementation of new TV transmission systems.

Another multichannel system, the Dolby stereophony surround multichannel system has already been used for years in motion picture applications. The Dolby system, which is a three-plus-one system with three front channels and one surround channel interleaved in two transmission/recording channels, is also offered for domestic use. The advantages of a mid-plane loudspeaker in the case of this three-channel matrix transmission of front or primary information have also been proven with this system, in spite of the matrixing circuit used taking into consideration the two-channel film. Apart from a discrete mid-channel, the main difference between the Dolby stereophony surround system and the above-mentioned recommendations is in the different number of surround channels.

Investigations have clearly shown that two channels of decorrelated room (spatial) information provide a substantially better coverage than the one channel commonly used so far.

In order to reduce the disadvantages, especially with regard to the insufficient provision of spacial information, two reproduction loudspeakers for the two-channel spacial information have been integrated in the overall reproduction arrangement. This approach is similar to the initial practice commonly used in the case of two-channel or one-channel spacial information in the stereo ambiophony system developed in 1960 by Keibs and also to the later practice with the Dolby stereophony surround system in the case of one-channel spacial information. This variant too, however, only provides relevant advantages in the overall impression if the defects of directional allocation and insufficient provision of sound to the listener are overcome.

The shortcomings of one-channel reproduction of room information have more recently been reconsidered and have lead, in addition to the proposal of the ITU and SMPTE standards, to new motion picture sound methods in which two-channel room information is used.

Furthermore, two-channel reproduction arrangements are known in which subaudio frequency reproduction (up to approximately 120 Hz) is performed by means of separate loudspeakers, so-called subwoofers, apart from the reproduction of the directional signals, thereby allowing the individual loudspeakers to be physically smaller. Applying this method to the above-mentioned international recommendations produces a 3/2/1 system or at most a 5/2/1 system, respectively.

Such a sophisticated sound signal reproduction exhibits improved reproduction quality with respect to the representation of three or more channels of front information and to the spacial information within a slightly enlarged listening area.

Outside the defined listening area, which is very small in relation to the overall room size, location errors have far more negative effects. The distributed front signals are not reproduced with true direction but are always heard only from the nearest loudspeaker. The two channels of spatial information are largely perceived differently depending on the position of the listener.

The need also exists for covering large listening areas, such as auditoriums, in an optimum way, as addressed in German Patent No. 34 13 181. This, however, requires sources to be handled separately, entailing a substantial expenditure which cannot be justified for one transmission and small rooms.

But in the case of home sound reproduction applications, the disadvantage of the small listening area, especially in connection with high-quality image reproduction, is serious, since the dependence on listening position is too great a restriction and also constitutes a great obstacle to the implementation of such methods for home use.

The variety and steady extension of proposals and recommendations for different applications confirm the insufficiency of the known methods described and the need for a widely applicable solution for the improved reproduction of multichannel sound systems.

SUMMARY OF THE INVENTION

It is an object of the present invention to enable an enlargement of the defined listening area for transmitted and/or recorded two-channel and multichannel stereo signals with a view to a listener-position-independent reproduction of spatial information while maintaining the directional information of the individual sound signal sources. In so doing, it should be possible for the loudspeakers to be placed conveniently within the site distribution options possible with the given room size. At the same time, the method and apparatus of the present invention increases the portion of the overall room size that can be used for acoustic and/or visual purposes. Such an improvement is also possible in larger rooms. In this connection, it has to be taken into account that pseudo-multichannel reproduction conditions are to be produced by converting available program materials having less than 5 channels.

DETAILED DESCRIPTION OF THE DRAWINGS

Figure 1:
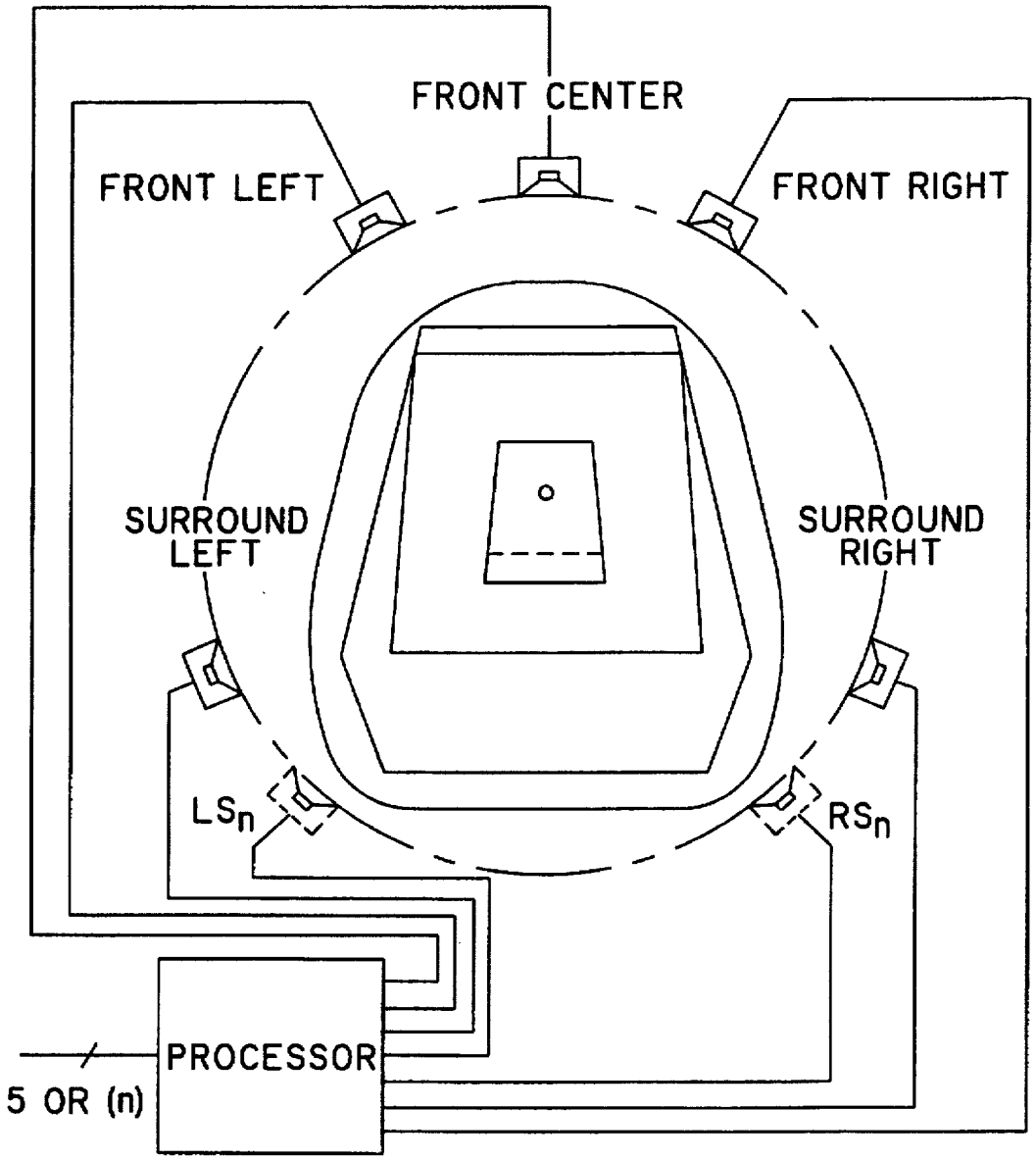
FIG. 1 illustrates a comparison of stereophony listening zones in the case of conventional 5-channel reproduction and in the case of the system of the present invention (shaded area).

With known two-channel stereophonic reproduction systems, the listening area is restricted to a single listening reference seat, as shown in FIG. 1. As also shown in FIG. 1, a standard 3/2 multichannel arrangement allows only a minor enlargement of the listening area.

The method and apparatus of the present invention allows enlargement of the stereophonic listening zone, as shown in FIG. 1, while maintaining the complex listening impression to be reached. As will be explained more fully below, additional left and right surround reproduction loudspeakers $LS_n$ and $RS_n$ can be provided with the system of the present invention.

Another significant advantage provided by the present invention arises from the positioning of the loudspeakers in the respective individual reproduction range, which is not rigidly bound to the standard arrangement.

To also enable the advantageous reproduction of multichannel programs transmitted in conformity with a matrix method, as for example by means of the Dolby stereo surround system, an apparatus in accordance with the present invention is required behind the decoder that is usually employed (such as the Dolby Pro Logic Surround Decoder), which apparatus is able to process a five-channel or 5-plus-1-channel program as well as other single-channel or multichannel programs, as desired.

In accordance with the present invention, a loudspeaker arrangement which is available for multichannel reproduction and which is set up in a room taking into account the standard and the existing capabilities, is supplemented by an apparatus which is connected between a radio, TV receiver or other equipment for reproducing multichannel sound recordings, and power stages for driving the individual loudspeakers. An embodiment of such an apparatus is shown in FIG. 2.

Figure 2:
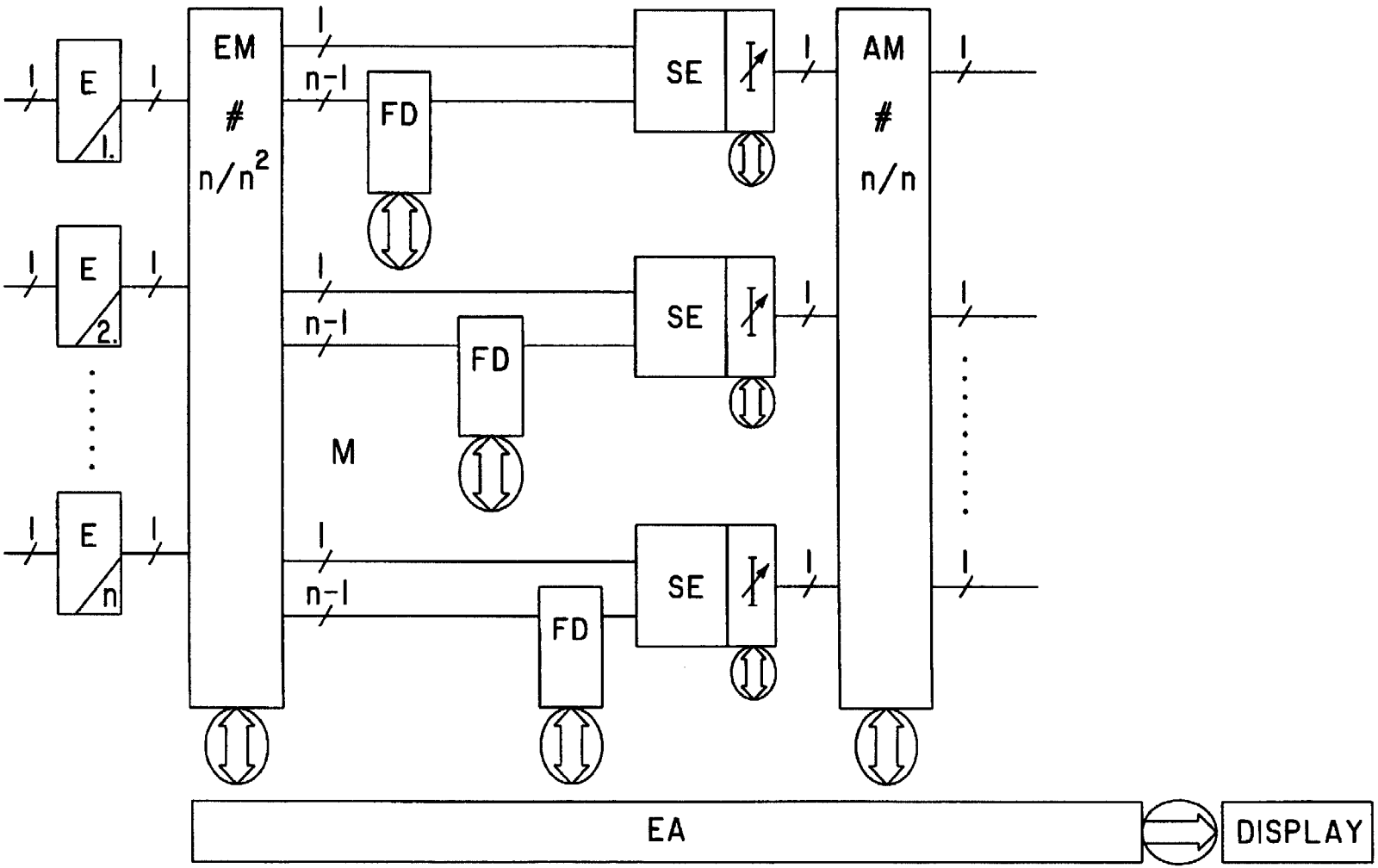
FIG. 2 is a block diagram of a first exemplary embodiment of a system in accordance with the present invention.

FIG. 2 is a block diagram of a first exemplary embodiment of a multichannel sound processing system in accordance with the present invention. The system of FIG. 2 comprises n input stages E, an input matrix EM, processing or functional units FD, summing and level adjusting stages SE, an output matrix AM, an "intelligent" input unit EA and a display. The functional units FD provide multichannel, independent correction of signal delay, level and, if necessary, phase.

The inputs of the input stages E are coupled to the outputs of a multichannel receiver or any other single-channel or multichannel program source. The outputs of the input stages E are coupled with inputs of the input matrix EM. The input matrix EM, which has outputs coupled to inputs of the functional units FD, distributes the input signals to the functional units FD so that each functional unit FD receives n-1 of the n available input signals. The n-1 outputs of each functional unit FD are connected with n-1 inputs of each summing stage SE. One unprocessed input signal is provided to each summing stage SE via a direct connection between the input matrix EM and each summing stage SE. Each summing stage SE thereby generates an aggregate signal from the n input signals.

The aggregate signals generated by the summing stages SE differ from each other by the fact that in each aggregate signal there are available differently processed signals and one unprocessed signal out of the number of signals applied to the input stages E of the system.

The outputs of the summing stages SE, whose levels are variably controllable, are connected to inputs of the output matrix AM which, in turn, couples the outputs of the summing stages SE to the existing reproduction channels connected to the system, e.g., with the inputs of power amplifiers. The output matrix AM thus allocates each of the outputs of the summing stages SE to the relevant reproduction channel.

Figure 3:
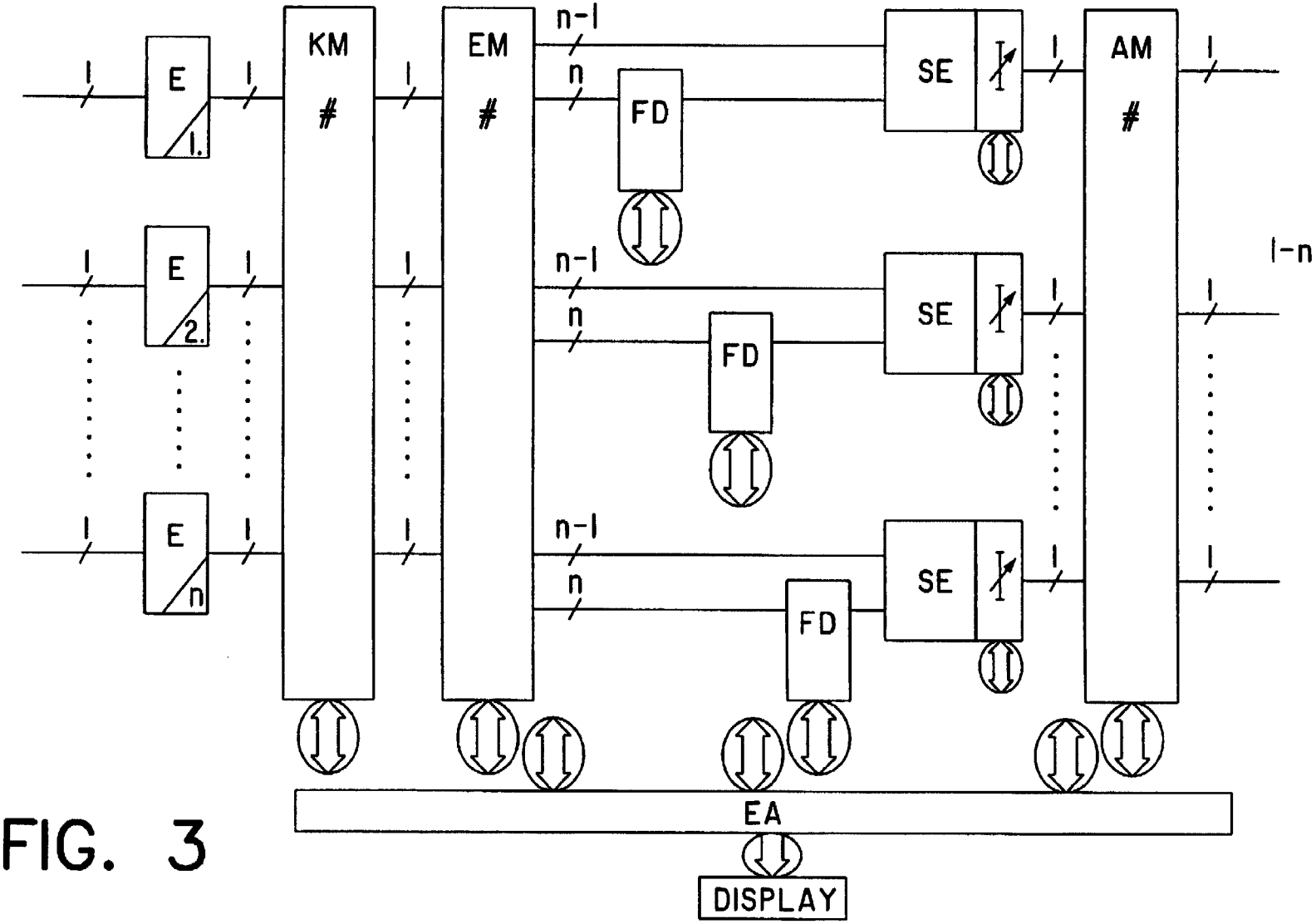
FIG. 3 is a block diagram of a second exemplary embodiment of a system in accordance with the present invention.

FIG. 3 is a block diagram of a second exemplary embodiment of the system of the present invention. For applications involving the multichannel reproduction of a program with less than 5 signals, the embodiment of FIG. 3 modifies the embodiment of FIG. 2 by adding a conversion matrix KM between the input stages E and the input matrix EM, which conversion matrix distributes the existing input signals to the input matrix EM. In this case, the outputs of the input stages E are connected with the inputs of the conversion matrix KM, whose outputs are, in turn, connected with the relevant inputs of the input matrix EM.

Figure 4:
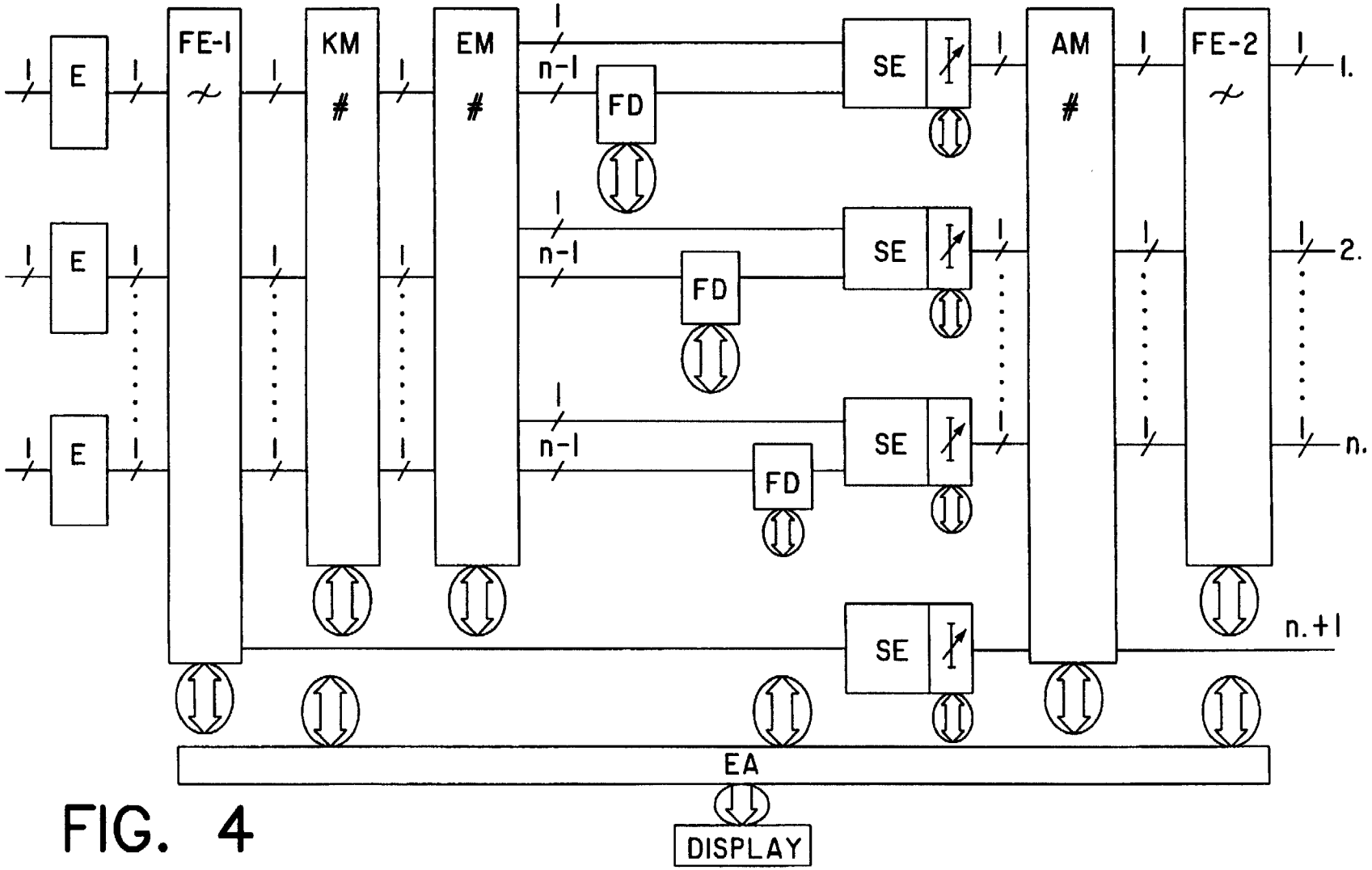
FIG. 4 is a block diagram of a third exemplary embodiment of a system in accordance with the present invention, in which a subaudio frequency channel is generated for driving a separate subwoofer loudspeaker.

As far as a separate low-frequency channel for the subbass range is not contained in the program signal, a filter unit FE-1 can be connected to the outputs of the input stages E to generate a separate low-frequency channel, as shown in FIG. 4. The filter unit FE-1, by using a low-pass circuit coupled to the available input signals, preferably the three front signals, filters out and sums up the low-frequency signal portions and allocates the resultant signal to its own low-frequency channel.

Figure 5:
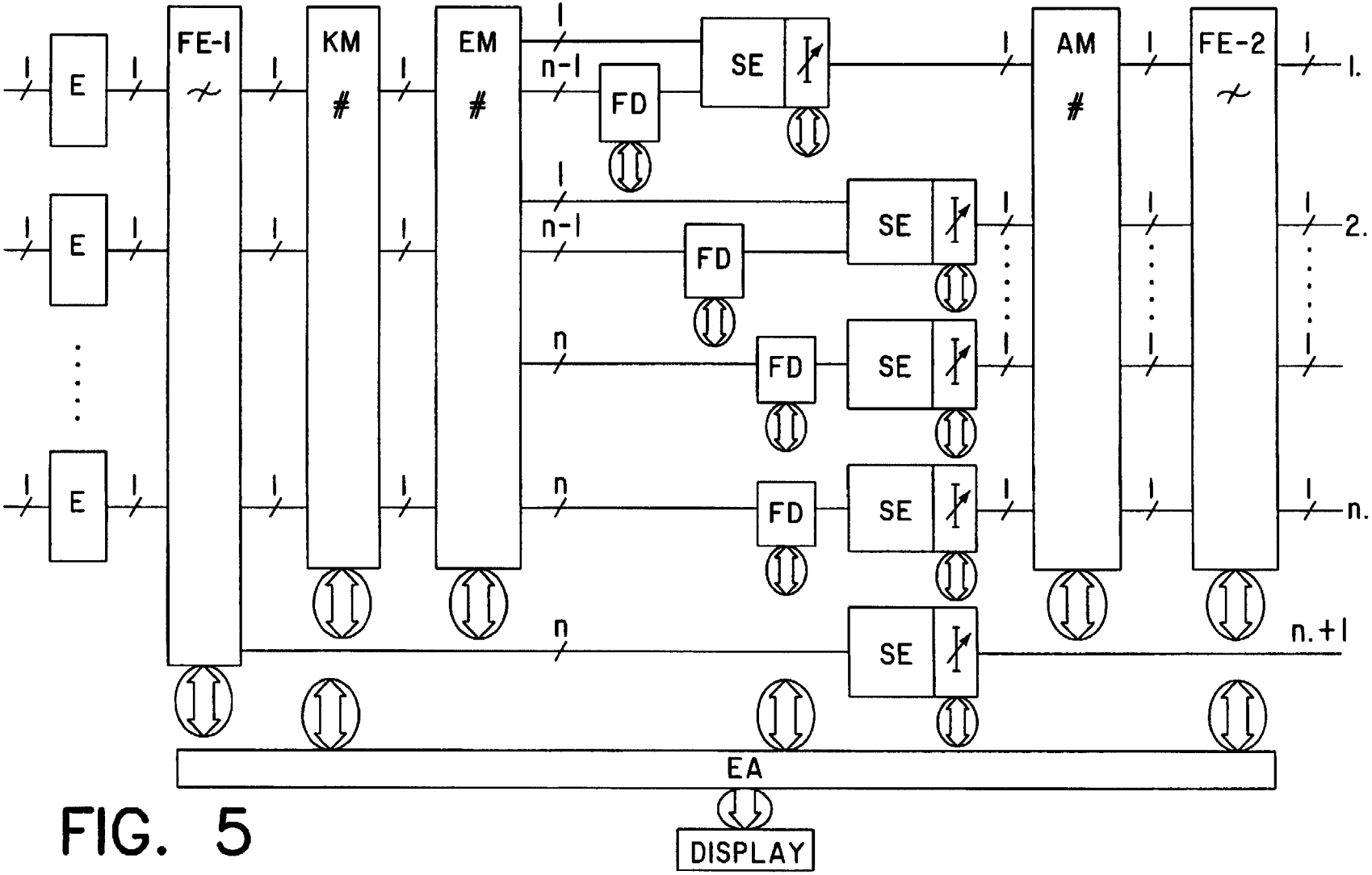
FIG. 5 is a block diagram of a fourth exemplary embodiment of a system in accordance with the present invention, for supplementary reproduction channels in larger rooms.

To adapt the loudspeakers to the existing room conditions, it is possible—as was already done with stereophonic reproduction in high-quality domestic reproduction arrangements—to connect an additional filter module FE-2 behind the output matrix AM for the reproduction channels, as shown in FIGS. 4 and 5.

To ensure an optimized acoustic adaptation of the reproduction arrangement to the existing room conditions, loudspeaker locations and desired listening area, the above-described apparatus must be assigned to an input unit EA.

The input unit EA allows inputting of the loudspeaker locations, loudspeaker parameters, the existing room conditions, including listener positions and, furthermore, provides the possibility of correcting and adapting the relations between direct information and desired spatial information (R/D) in dependence on the program material.

In terms of control, the input unit EA is connected with the individual modules of the system of the present invention and controls the variably adjustable parameters of the individual modules. The input unit EA independently calculates parameters on the basis of the room and location parameters input and allocates the calculated parameters to the respective modules.

As a supplement to the input unit EA, an indication on a display coupled to the input unit EA is used to provide visual monitoring of the parameters input.

If there is a need to cover larger listening zones, additional functional units FD can be inserted, the inputs of which are connected with all outputs of the input matrix EM. As such, an aggregate signal consisting of all, but differently processed, input signals is formed for each additional 1 to m reproduction channel, which is connected with additional distributed loudspeakers. (FIG. 4)

Figure 6:
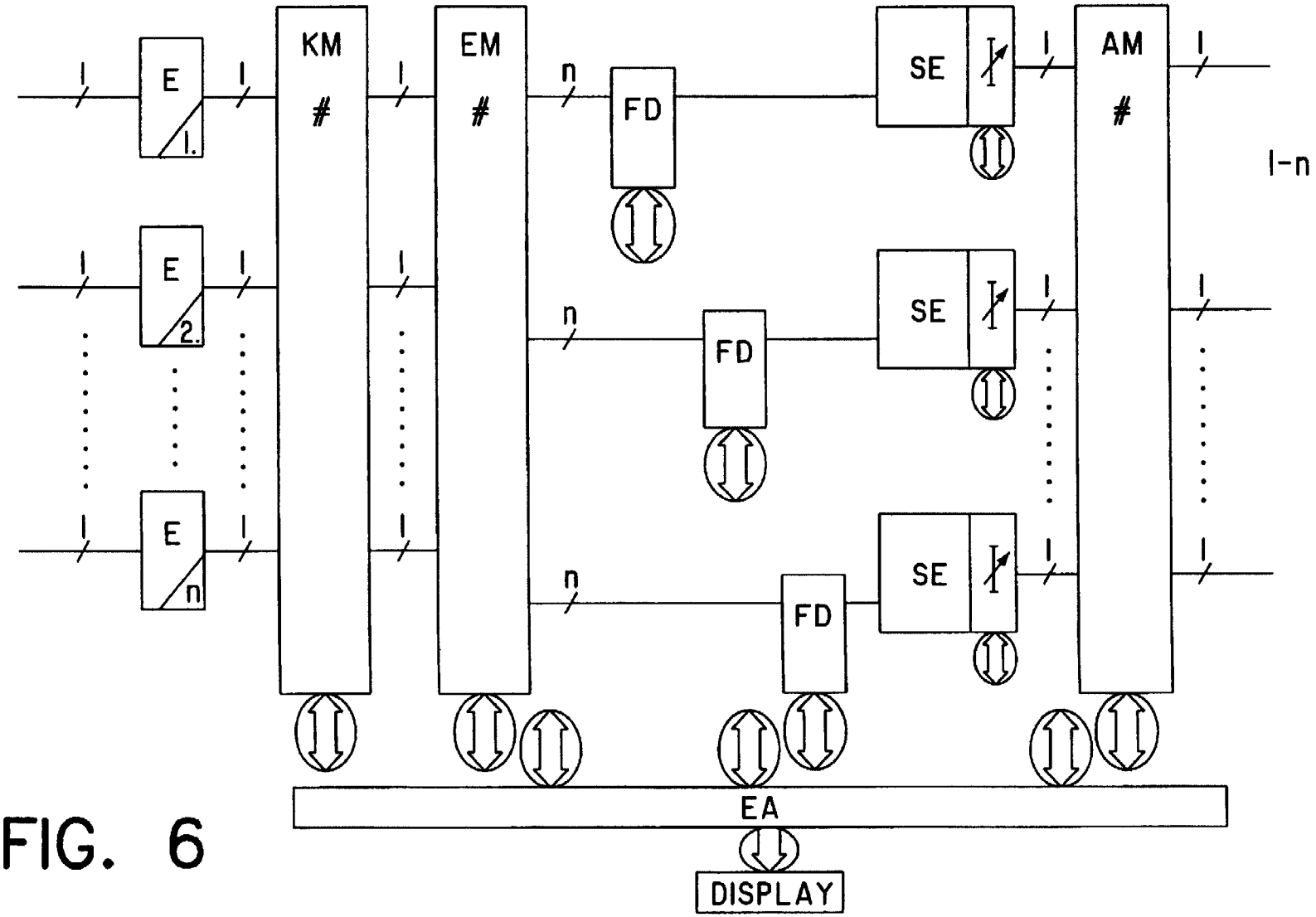
FIG. 6 is a block diagram of a fifth exemplary embodiment of a system in accordance with the present invention, which provides a configuration for the processing of all channels.

FIG. 6 shows another exemplary embodiment of the system of the present invention in which each input signal, including the signals not processed, is coupled to a summing stage SE via a functional unit FD, thereby simplifying the circuit configuration.

The signal flow in a five-channel program will now be described. The signals provided from the source, such as a transmission channel, multichannel recording, etc., arrive at the input stages E of the system of the present invention. The input signals are distributed by the input matrix EM to the existing functional units FD so that each functional unit FD is assigned four of the five available input signals. This means that each functional unit FD accommodates one signal which is not subjected to parameter correction. In the first functional unit FD, the first signal is switched to the next summing stage without having been processed, in the second functional unit FD the second signal is switched without processing, etc.

In each of the summing stages SE, the four processed signals, which are handled independently with regard to level, delay and phase, and the respective one unprocessed signal are summed and corrected in terms of level. At the outputs of the output matrix AM, these aggregate signals are allocated to the existing reproduction channels and are routed via power stages to the loudspeakers in conformity with their functional destination (e.g., front loudspeaker or surround loudspeaker).

In a modification of the system of the present invention, the functional units FD can perform a parameter change for all input channels so that a sum of all available and processed input signals arises for each reproduction channel. (FIG. 6)

If, as in the embodiments of FIGS. 4 and 5 there is a filter unit FE-1 connected behind the input stages, the low-frequency portions of the individual source signals not handled will be filtered out, summed in a summing stage SE and allocated to a separate low-frequency channel which drives a specific woofer, via an appropriate power unit, using a level correction unit.

Moreover, in most applications, a positioning of the loudspeakers that is not in conformity with the standard and the optimum arrangement of listener positions, which is often difficult to adhere to in practice, as well as spatial conditions, require a frequency response correction of the loudspeakers adapted to the desired listening area and, if appropriate, a longtime correction of the reproduction channels in dependence on their location. The latter correction can be performed in the functional units FD.

To ensure successful room adaptation of the frequency response, it is possible, as shown in FIGS. 4 and 5, to couple the output signals of the output matrix AM with the inputs of the power amplifiers of the reproduction channels through the filter module FE-2, which comprises room correction filters.

By inputting appropriate correction values, via the input unit EA, the room correction filters can be configured to allow adaptation of the sound color of the whole reproduction arrangement, by means of changes in the reproduction channels, to the given room and user requirements.

The deviations from a standard setup can be corrected by entering the location parameters into the input unit EA. By entering additional parameters such as loudspeaker data, listening zone or listeners' positions, etc. it is possible both to correct the loudness ratios and to optimize the listening conditions outside an optimum listener position, particularly in the user's preferred area, or preferred listener position.

Likewise, the ratio of direct proportion and surround proportion may be changed, stored and, having been allocated to the current program, polled again by entering the relevant correction values in the existing input unit EA in dependence on the program material.

The conversion matrix KM, connected ahead of the input matrix EM, makes it possible to use the apparatus of the present invention for the reproduction of program material with less than five sound channels.

What is claimed is:

1. A method for processing multichannel sound signals representing at least three front and two surround channels, the method comprising the steps of:

distributing the signals into groups of signals, with each group including at least one first signal and at least one second signal;

processing each first signal in each signal group by modifying at least one parameter selected from the group of signal parameters consisting of delay, level and phase position;

summing together the processed first signals and the second signals of each signal group thereby generating an aggregate signal for each signal group; and distributing the aggregate signals to the at least three front and the two surround reproduction channels and to at least one additional surround reproduction channel, in accordance with a directional allocation of the respective second sound signals, wherein the reproduction channels are used to drive loudspeakers arranged in a room.

2. The method according to claim 1, wherein the at least one additional surround reproduction channel is provided with at least one aggregate signal which is generated from first signals subjected to a reduction in level and an increase in delay, the reduction in level and increase in delay being performed in accordance with a distance from loudspeakers driven by the at least two surround reproduction channels and an allocated service area of loudspeakers driven by the at least one additional surround reproduction channel.

3. The method according to claim 1, wherein the step of processing each first signal includes processing each second signal in at least one signal group.

4. An apparatus for multichannel sound reproduction, comprising:

at least five input stages for receiving at least three front and two surround input sound signals;

an input matrix with at least five inputs, each input being coupled to an output of each input stage;

a plurality of functional units with inputs coupled to outputs of the matrix, each functional unit performing independent processing of applied signals with regard to delay, level and phase, if appropriate;

a plurality of summing stages with first inputs coupled to outputs of the matrix and with second inputs coupled to outputs of the functional units, each summing stage generating an aggregate signal as a function of processed and unprocessed input signals; and an output matrix for distributing the aggregate signals to the at least three front and two surround channels.

5. The apparatus according to claim 4, further comprising a conversion matrix inserted before the input matrix for distributing sound signals on less than five sound channels to the at least five inputs of the input matrix.

6. The apparatus according to claim 4, further comprising a multichannel filter unit inserted before the input matrix and including a plurality of low-pass filters and a summation stage, wherein the low-pass filters pass subaudio frequency portions of the input sound signals and which subaudio frequency portions are summed by the summation stage and allocated to a separate sub-bass channel for coupling to a subwoofer loudspeaker.

7. The apparatus according to claim 4, further comprising an input unit for entering desired parameters and information relating to spatial conditions of the reproduction arrangement.

8. The apparatus according to claim 7, further comprising a display coupled to the input unit for indicating entries and parameters to be changed.

9. The apparatus according to claim 7, wherein the input unit allows modification of additional parameters of the sound signals and is coupled with components, including the matrices, filter units, functional units and summing stages elements, which affect the sound signal paths via their processing elements including necessary parameter values from the entered room parameters and individual specifications.

10. The apparatus according to claim 7, wherein the desired parameters include volume range ratios of the front and the surround channels and the information relating to spatial conditions of the reproduction arrangement includes loudspeaker positions.

11. The apparatus according to claim 7, wherein the display indicates delay correction, level correction and correlation level correction.

* * * * *